United States Patent [19]

Sheff

[11] 4,075,624

[45] Feb. 21, 1978

[54] ELECTRONIC SIREN STRUCTURE AND METHOD

[76] Inventor: Richard M. Sheff, 6564 E. Michigan Ave., Saline, Mich. 48176

[21] Appl. No.: 469,945

[22] Filed: May 15, 1974

[51] Int. Cl.[2] ..... G08B 3/00

[52] U.S. Cl. ..... 340/384 E; 340/384 R

[58] Field of Search ..... 340/384 R, 384 E, 405; 35/12 Q; 331/78, 56, 49

[56] References Cited

U.S. PATENT DOCUMENTS

| | | | |
|---|---|---|---|
| 2,910,688 | 10/1959 | Kelley | 331/49 |
| 3,378,773 | 4/1968 | Jeffers | 325/139 |
| 3,718,987 | 3/1973 | Carver | 340/384 E |
| 3,747,092 | 7/1973 | Smith | 340/384 E |
| 3,810,169 | 5/1974 | Locke | 340/384 E |
| 3,868,684 | 2/1975 | Nunn | 340/384 E |

*Primary Examiner*—Harold I. Pitts
*Attorney, Agent, or Firm*—Whittemore, Hulbert & Belknap

[57] ABSTRACT

An electronic siren including yelp and wail oscillators, means for mixing the signals from the yelp and wail oscillators, and an amplifier output circuit for broadcasting the mixed yelp and wail signals. The wail oscillator is adapted to operate automatically or may be operated manually by means of a push button or from remote switching means. The wail oscillator may also be switched to operate with a siren sound or a horn sound having a variable pitch. The amplifier output circuit is also utilized as an output circuit for a variable volume microphone or radio input signal thereto. Additional amplifier structure for increasing the output of the electronic siren is also provided in accordance with the invention.

In operation, the electronic siren will provide a microphone or radio output, a manually selected automatic siren or horn sound output from the wail oscillator, the output of both the wail and yelp oscillators simultaneously, or the output of the yelp oscillator. The manually selected horn or siren sound output of the wail oscillator may also be initiated manually and under control of a remote switch. Optionally, the yelp oscillator may be remotely operated also.

11 Claims, 5 Drawing Figures

ELECTRONIC SIREN STRUCTURE AND METHOD

BACKGROUND OF THE INVENTION

1. Field of the Invention

The invention relates to electronic sirens of the type used in conjunction with emergency vehicles such as police cars, fire engines, ambulances, and the like, to warn of the approach of the vehicles. The sirens of the invention may be used in any application requiring a loud alerting sound and may be used in either a fixed or mobile installation.

2. Description of the Prior Art

In the past, such electronic sirens have generally included a single yelp oscillator or wail oscillator. Wherein broadcasting from a microphone or a radio from emergency vehicles having mechanical sirens in contrast to electronic sirens has been required in the past, equipment to effect such broadcasting has been provided separately.

SUMMARY OF THE INVENTION

The invention comprises a completely electronic siren including a yelp oscillator, a wail oscillator, and controlling oscillators. The wail oscillator has associated switch means for providing a siren or variable pitch horn sound output therefrom and as shown may be actuated automatically or manually from a siren push button or a remote switch. The yelp oscillator as shown is automatically actuated, but may optionally be manually actuated. The electronic siren further includes means for mixing the signals from the yelp and wail oscillators, and an amplifier output circuit for broadcasting the output from the mixer through a suitable externally connected speaker not provided with the present invention. Means for selecting one of the yelp oscillator, wail oscillator, or a simultaneous yelp oscillator and wail oscillator signal for feeding into the mixer are also included in the electronic siren.

Structure is also provided in conjunction with the output circuit for providing a variable volume microphone input or radio input to the output circuit. Thus, the output circuit of the electronic siren is useful as a public address system.

In addition, optional add-on amplifier output structure provides for increased power output from the electronic siren structure.

In operation, a multipart selector switch having public address, radio, manual, duosonic, automatic and yelp positions permits operation of the electronic siren in a plurality of separate modes. The electronic siren acts as a public address system from a microphone input or from a radio input in the first and second positions respectively of the selector switch. The output from the electronic siren with the selector switch in a third or manual position will provide either a horn or siren sound output from the wail oscillator in accordance with the position of a horn or siren two-position switch or optionally, a push button yelp is provided for in the manual position if this connection (not shown) is elected. In the fourth or duosonic position of the selector switch, both the output of the yelp and wail oscillators are provided through the mixer to the output circuit. In the fifth or auto and sixth or yelp positions of the selector switch, the wail oscillator and yelp oscillator signals alone respectively are fed through the mixer to the output circuit.

DESCRIPTION OF THE PREFERRED EMBODIMENTS

Figure 2:
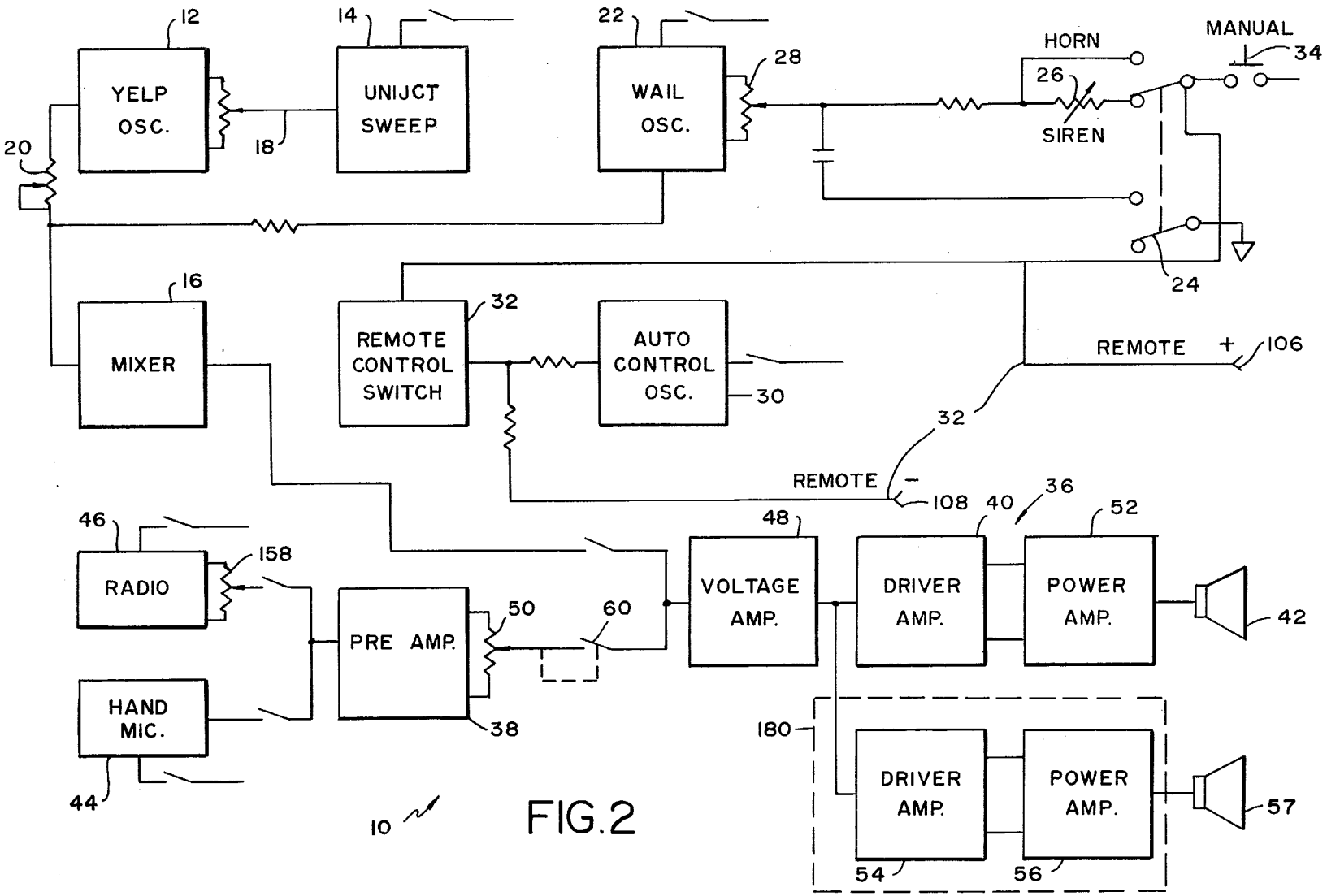
FIG. 2 is a simplified block diagram of the electronic siren illustrated in FIG. 1.

As shown best in FIG. 2, the electronic siren 10 includes a yelp oscillator 12 driven by a sweep circuit 14. The oscillator 12 provides a yelp signal into the mixer 16. The balance of the yelp oscillator is determined by the setting of the potentiometer 18, while the ratio of the output from the yelp oscillator to the output from the wail oscillator is controlled with the rheostat 20.

The wail oscillator 22 provides a signal to the mixer 16 which is either a siren or a horn sound depending upon the position of the siren or horn selector switch 24. The pitch of the horn sound may be varied by means of the setting of the rheostat 26, while the potentiometer 28 determines the balance of the wail oscillator 22.

Automatic driving of the wail oscillator 22 is accomplished by the auto control oscillator 30 through the remote control switch circuit 32. The wail oscillator may also be actuated manually by means of push button 34 or from a remote switch (not shown) through the remote switch circuit 32.

Signals from the yelp oscillator and/or the wail oscillator are mixed in accordance with the setting of the rheostat 20 in the mixer 16 and are passed directly to the voltage amplifier stage 48 of the output amplifier circuit 36 from which they pass through the driver amplifier stage 40 and power amplifier stage 52 to the speaker 42.

The use of the voltage amplifier, driver amplifier and power amplifier stages 48, 40 and 52 in the output circuit of the electronic siren 10 used as a public address system is accomplished by feeding either a signal from the microphone circuit 44 or a radio circuit 46 into a preamplifier circuit 38 in which the volume is varied by a potentiometer 50 in switch 60. The signal from the preamplifier circuit 38 is then fed into the voltage amplifier circuit 48 of the electronic siren 10.

The output of the electronic siren 10 may be increased, if desired, by adding a second series connected driver amplifier 54 in series with a second power amplifier 56 in parallel with the series driver amplifier 40 and power amplifier circuit 52 to a second speaker 57. As shown, the driver amplifier 54 and power amplifier 56 are in series with voltage amplifier 48. The second driver amplifier 54 and power amplifier circuit 56 are provided as an optional add-on unit 180 to the siren 10.

A regulated voltage supply (not shown) in the block diagram of FIG. 2 is provided for the electronic siren 10. The regulated voltage supply provides a separate bias voltage for the electronic siren 10 as well as the required regulated operating voltage from an approximately 12-volt direct current raw voltage source found in most emergency vehicles.

Figure 1:
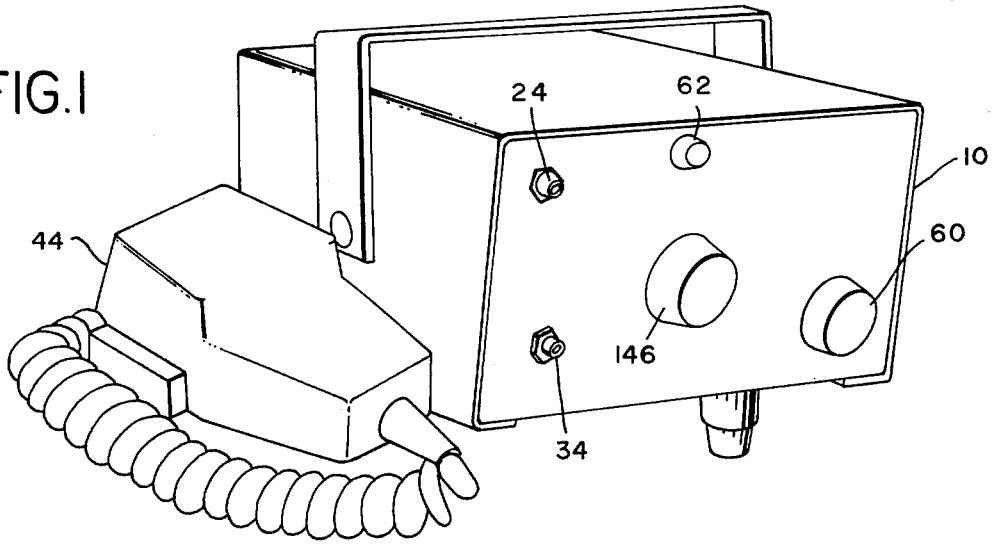
FIG. 1 is a perspective view of the electronic siren of the invention including a microphone input thereto.

The switch 60 is an ON-OFF volume switch and is provided in addition to the manual push button 34 and siren-horn selector switch 24 along with an indicator light 62 which indicates that power is applied to the electronic siren 10 as exterior controls on siren 10. The controls on the electronic siren 10 are then completed by a 6-position, 6-part selector switch 146. The positions of the selector switch, as best shown in FIG. 1, are public address, radio, manual, duosonic, auto and yelp. The complete operation of the electronic siren 10 in conjunction with these controls, will be considered subsequently.

Figure 3A:
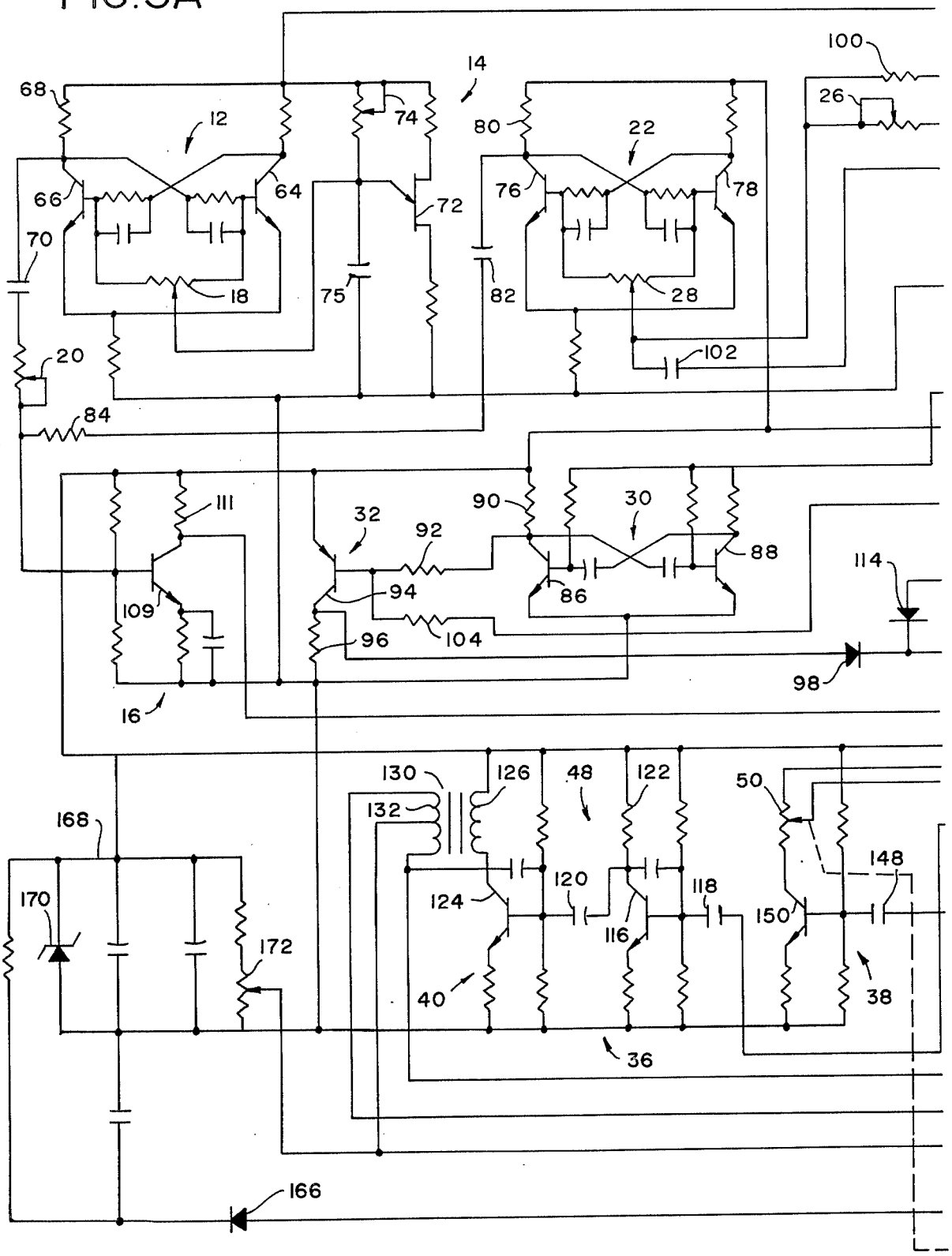
FIGS. 3A and 3B together are a partly schematic, partly block diagram of the electronic siren illustrated in FIGS. 1 and 2.
Figure 3B:
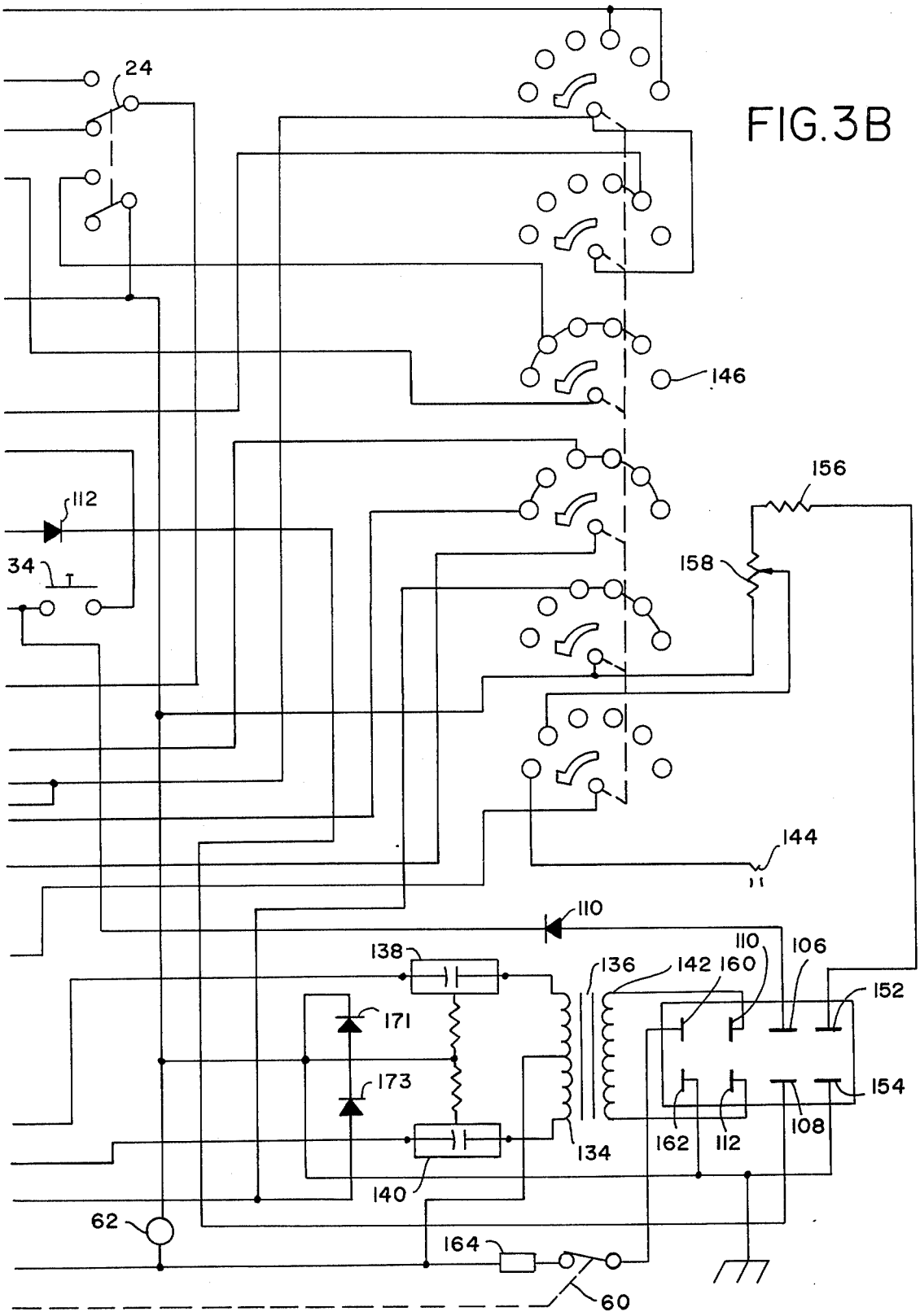

Referring now to FIG. 3 in more detail, the yelp oscillator 12 is a voltage controlled oscillator circuit including transistors 64 and 66. As shown in FIG. 3, the potentiometer 18 is connected between the bases of the transistors 64 and 66 to vary the balance of the oscillator circuit and determine the symmetry of the transistors 64 and 66. The output of the yelp oscillator circuit is taken across the resistor 68 through the capacitor 70 and the rheostat 20.

As indicated above, the yelp oscillator 12 is driven from the unijunction transistor sweep circuit 14, which sweep circuit includes the unijunction transistor 72. The sweep time of the sweep circuit 14 is determined by the setting of the rheostat 74.

In operation, the sweep circuit sweeps at, for example, a frequency of 3 hertz, while the multivibrator may have a frequency which varies from 400 to 1,200 hertz during the sweep of the sweep circuit. Thus, as voltage builds up on capacitor 75, the frequency of yelp oscillator 12 increases until the unijunction sweep circuit 14 fires and the yelp oscillator returns to its original state awaiting another sweep of circuit 14.

The wail oscillator is also a voltage controlled oscillator including the transistors 76 and 78 and the potentiometer 28. The output of the wail oscillator, which also varies from 400 to 1,200 hertz, is taken across the resistor 80 and through the capacitor 82 and resistor 84 to the mixer 16.

The auto control oscillator 30 for driving the wail oscillator 22 again is an astable multivibrator having a period of between 5 and 6 seconds. Oscillator 30 includes the transistors 86 and 88. The output of the auto control oscillator 30 is across the resistor 90 and through resistor 92 to the remote control switch circuit 32.

The remote control switch circuit 32 includes the transistor 94. The output of the remote control switch 32 is across the resistor 96 through the diode 98, through the siren or horn selector switch 24 and across either the resistor 100 or the rheostat 26 to the potentiometer 28 of the wail oscillator 22.

Figure 4:
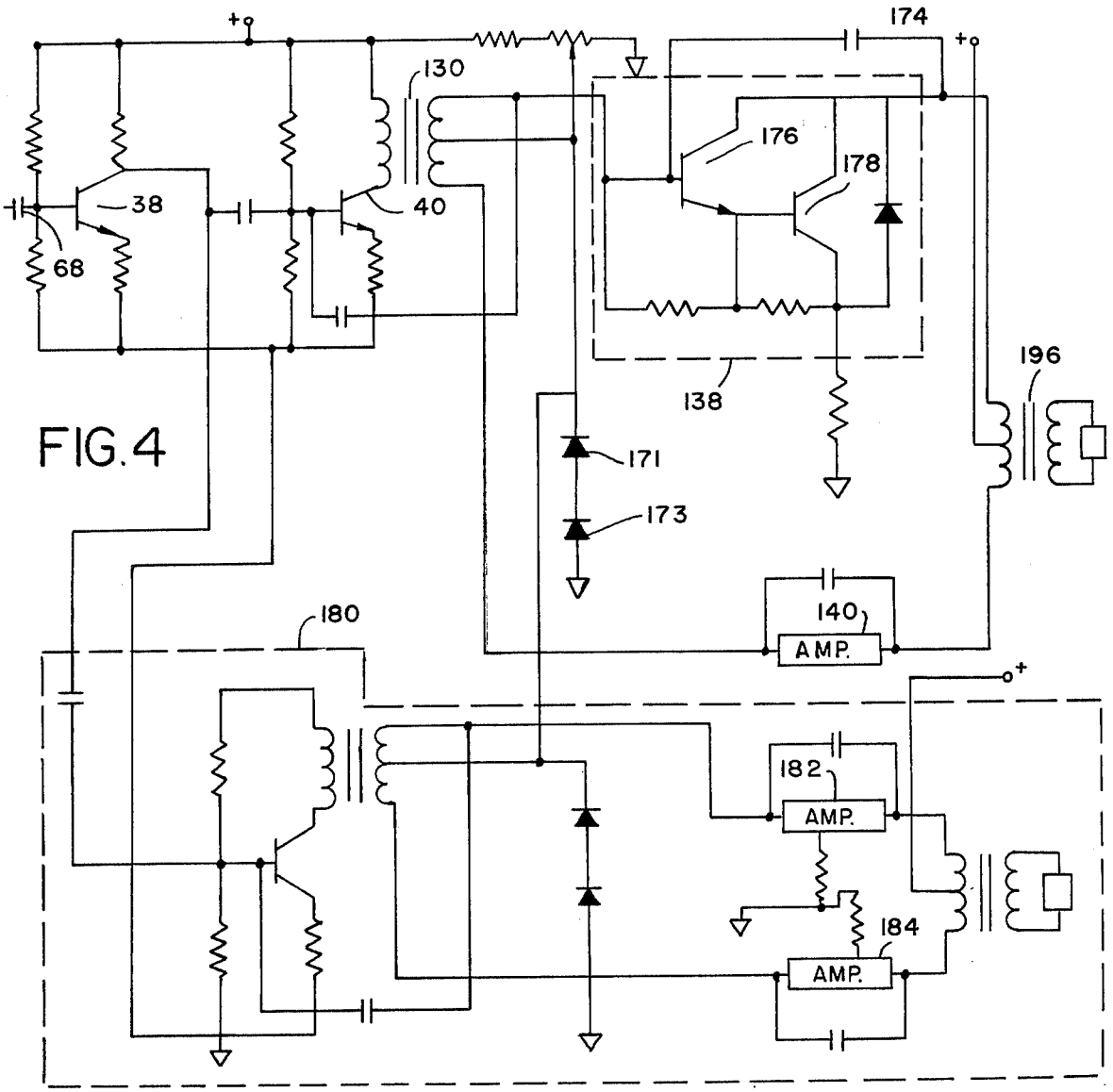
FIG. 4 is a partly schematic, partly block diagram of a portion of the amplifier output structure of the electronic siren of FIGS. 1–3 and added output amplifier structure for increasing the power output of the electronic siren of FIGS. 1–3.

The position of the siren or horn selector switch 24 determines whether the wail oscillator will operate with a normal siren sound having a frequency of between 400 and 1,200 hertz with the switch 24 in the "down" position, as shown in FIG. 4, or as a variable pitch horn having a constant tone of approximately 600 hertz with the switch 24 in the "up" or horn position.

The upper section of the switch 24 provides the output signal of the remote switch 32 to the wail oscillator 22, while the lower portion of the siren-horn selector switch 24 places the capacitor 102 in the wail oscillator circuit in the siren position of the switch 24 and removes the capacitor 102 from the circuit with the switch 24 in the horn position.

As previously indicated, the remote control switch circuit 32 may also provide an output with the auto control oscillator 30 unenergized by means of a remote signal placed on the base of the transistor 94 through the resistor 104 and plug terminals 106 and 108.

Also, a direct signal can be sent to the wail oscillator by depressing the manual push button 34 through the diode 114 and siren or horn switch 24. Blocking diodes 110 and 112 are provided in conjunction with the remote operation of the wail oscillator 22 along with the diodes 98 and 114 to prevent undesired interaction of the wail oscillator input signals.

The mixer 16 includes a transistor 109. Input to the mixer is on the base of transistor 109 from the yelp and wail oscillators 12 and 22. Output from the mixer is across resistor 111 in the collector circuit of transistor 109 to the voltage amplifier 48.

The voltage amplifier 38 of output circuit 36, as shown in FIG. 3, includes a transistor 116 which is connected to receive the signal from the mixer 16 through capacitor 118 on the base thereof and to amplify the signal and connect it to the driver amplifier 40 across resistor 122 over capacitor 120.

The driver amplifier 40 again includes a transistor 124 having the primary winding 126 of a driver transformer 130 in the collector circuit thereof. The secondary winding 132 of the driver transformer 130 is connected through push-pull Darlington power amplifier circuits 138 and 140, one of which is shown in detail in FIG. 4, to the primary winding 134 of the output transformer 136, as shown. The secondary winding 142 of the output transformer 136 is connected to a speaker 42 over plug terminals 110 and 112.

The microphone input to the siren 10 is through jack 144, through part one of the 6-part switch 146 in the public address position and through the capacitor 148 into the preamplifier circuit 38.

The preamplifier circuit 48 includes the transistor 150 and has an output on the volume control potentiometer 50 connected in the collector circuit 30 of the transistor 150. The output of the preamplifier circuit 48 is then through part two of the switch 146 in the first position to the capacitor 118 and then through the voltage amplifier 38, the driver amplifier 40 and the power amplifiers 138 and 140 as with the output signals from the yelp and wail oscillators 12 and 22.

The connection of a radio signal to the electronic siren 10 is through the plug terminals 152 and 154, through the resistor 156 and across the potentiometer 158, then through part one of the switch 146, again through the capacitor 148 to the preamplifier circuit 38 and from the preamplifier circuit 38 back through part two of the switch 146 and through the capacitor 118 to the voltage amplifier 48, driver amplifier 40 and power amplifier 52 including circuits 138 and 140, as before.

The terminals 152 and 154 may be connected directly to two-way or monitor-type radios. The rheostat 158 determines the initial input volume from the radio circuit to the volume control circuit 48.

A 12-volt raw direct current signal is fed into the electronic siren through terminals 160 and 162. Terminal 162, as shown, is substantially at ground potential, while terminal 160, as shown, is 12 volts positive. The high voltage passes through the volume control ON-OFF switch 60, through fuse 164 and diode 166 to the voltage regulating circuit 168 including the regulating Zener diode 170.

Voltage is taken off the potentiometer 172 to provide a bias for the output circuit 36 in the public address and radio modes of operation. The bias provided by the potentiometer 172 and the series diodes 171 and 173 produce stable Class A operation of the output circuit at low power with automatic temperature compensation.

Both the regulated high voltage and the bias voltage are supplied to the previously described circuits or some of them, as shown in FIG. 3, to effect operation of the circuits in accordance with the position of the 6-position, 6-part selector switch 146.

In overall operation of the electronic siren 10, the volume ON-OFF switch is first turned on so that there is power applied to the electronic circuit as indicated by the indicator light 62. It is then decided whether the wail oscillator will operate in its siren or horn mode and the siren or horn selector switch 24 is manually positioned. The selector switch is then turned to one of its six positions to provide a desired output.

Thus, as set forth above, with the selector switch in its position one, or public address position, parts one and three of the selector switch are in use to provide a microphone input to the electronic siren 10 whereby the electronic siren becomes a public address system.

With the selector switch 146 turned to its second or radio position, again only parts one and three are used to provide a radio input signal to the electronic siren to provide a radio input public address system.

With the switch 146 turned to its third or manual position, parts two, three and four are utilized to permit manual operation of the electronic siren 10 and to provide an output from the wail oscillator in either the siren or horn mode on pressing of the manual button 34, or on actuation of a remote control switch connected across the terminals 106 and 108.

With the selector switch 146 turned to the fourth or duosonic position, parts two, three, four, five and six are used to provide a mixed output from the yelp and wail oscillators. The output from the wail oscillator will be in accordance with the setting of the siren-horn switch.

With the selector switch 146 turned to its fifth or auto position, the parts two, three, four and five are utilized to provide an output from the wail oscillator only. Again, this output will be in accordance with the setting of the siren-horn switch.

With the selector switch 146 turned to the yelp or sixth position, only parts two, three and six of the selector switch are utilized to provide an output only from the yelp oscillator. It will be noted that part six of the selector switch 146 serves to provide the indicated high voltage to the yelp oscillator in either the duosonic or yelp positions thereof.

Part five of the selector switch 146 provides regulated high voltage to the automatic control oscillator 30 to permit automatic operation of the wail oscillator in the duosonic and auto position thereof.

The fourth part of the selector switch 146 is provided to switch the capacitor 102 out of the circuit with the selector switch 146 in the yelp position.

The third part of the selector switch 146 is to provide connection from the preamplifier to the output circuit in the first and second positions thereof, and in the third, fourth, fifth and sixth positions thereof is to provide a connection from the mixer output 48 to the output circuit 36. In other words, part three of switch 146 selects either a radio or microphone or a siren input to the output circuit 36.

Part two of the switch 146 is again to provide bias to the electronic siren output circuit 36 with the selector switch in the public address and radio positions.

Part one of the switch 146 as indicated above is to provide an input circuit for the microphone jack 144 and the radio input signal.

Thus, operation of the electronic siren 10 consists of turning the power on in the electronic siren 10, selecting the siren or horn mode of operation for the wail oscillator, and dialing the selector switch 146 to the desired operation whereby a public address signal, radio broadcasting signal, manual or remote wail oscillator signal, duosonic wail and yelp oscillator signals combined, wail oscillator signal and yelp oscillator signals are provided as an output from the electronic siren structure.

If it is desired to provide a larger power output than is possible from the voltage amplifier circuit 48, driver amplifier circuit 40 and the power amplifier circuit 52 including circuits 138 and 140, the add-on amplifier circuit 180 illustrated in FIG. 4 including driver amplifier 54 and power amplifier circuit 56 including amplifier circuits 182 and 184 may be provided. Thus, for example, the amplifier circuit 180 may be added in parallel with the driver amplifier circuit 40 and the power amplifier circuit 52 to feed an additional speaker 57. The power output from the siren 10 may be increased from 100 watts to 200 watts with the add-on circuit 180, if desired.

The Darlington power amplifier circuits 52 and 56, as shown in FIG. 4, include separate power amplifiers 138, 140, 182 and 184. Individually, the power amplifiers include transistors 176 and 178 connected as shown.

While one embodiment and a modification of the electronic siren structure and method of the invention has been disclosed in detail, it will be understood that other embodiments and modifications are contemplated by the inventor. It is the intention to include all embodiments and modifications of the electronic siren structure and method as are defined by the appended claims within the scope of the invention.

What I claim as my invention is:

1. Electronic siren structure comprising a varying pitch yelp oscillator, means for driving the yelp oscillator to produce a square wave output therefrom, a varying pitch wail oscillator, means for driving the wail oscillator to produce a square wave output therefrom, mixer circuitry electrically connected to the yelp and wail oscillators for receiving and mixing square wave signals from the yelp and wail oscillators and providing a mixer output signal in accordance therewith, switch means connected to the yelp and wail oscillators and the mixer for switching the output signal from the mixer to one of the yelp oscillator signal separately, the signal from the wail oscillator separately, and the signal from the yelp and wail oscillators simultaneously, and output structure electrically connected to the yelp and wail oscillators for receiving the output signal from the mixer, and providing a signal output for warning of the approach of an emergency vehicle carrying the electronic siren structure.

2. Structure as set forth in claim 1 and further including means electrically connected to the wail oscillator for alternatively providing an electronic horn sound and a siren sound output from the wail oscillator.

3. Structure as set forth in claim 1 and further including switch means operable in conjunction with the wail oscillator for permitting remote operation of the wail oscillator.

4. Structure as set forth in claim 1 and further including a manual switch for permitting manual operation of the wail oscillator.

5. Structure as set forth in claim 1 and further including means connected to the output structure for permitting microphone input to the output structure whereby the electric siren operates as a public address system.

6. Structure as set forth in claim 1 and further including means connected to the output structure for connecting a radio signal into the output structure whereby the electronic siren operates as a radio broadcast system.

7. Structure as set forth in claim 1 and further including means for adding amplifier structure to the electronic siren for increasing the power output thereof.

8. The method of providing an alerting signal to warn of the proximity of an emergency vehicle or the like composed of producing a varying pitch square wave yelp oscillator signal, producing a varying pitch square wave wail oscillator signal, and selectively broadcasting the yelp oscillator signal, the wail oscillator signal, and the yelp and wail oscillator signals simultaneously.

9. The method as set forth in claim 8 and further including selectively broadcasting at least one of a microphone signal and a radio signal instead of signals from the yelp and wail oscillators.

10. The method as set forth in claim 8 and further including the step of adding power to the output of the signals broadcast by the siren structure.

11. Electronic siren structure comprising a varying pitch yelp oscillator, means for driving the yelp oscillator to produce a square wave output therefrom, a varying pitch wail oscillator, means for driving the wail oscillator to produce a square wave output therefrom, mixer circuitry electrically connected to the yelp and wail oscillators for receiving and mixing square wave signals from the yelp and wail oscillators and providing a mixer output signal in accordance therewith, an output structure electrically connected to the mixer for receiving the output from the mixer and providing a signal output for warning of the approach of an emergency vehicle carrying the electronic siren structure.

* * * * *